US008937525B2

(12) United States Patent
Tseng et al.

(10) Patent No.: US 8,937,525 B2
(45) Date of Patent: Jan. 20, 2015

(54) SURFACE MOUNTABLE OVER-CURRENT PROTECTION DEVICE

(71) Applicants: Chun Teng Tseng, Sanwan Township, Miaoli County (TW); David Shau Chew Wang, Taipei (TW); Chi Jen Su, Taipei (TW)

(72) Inventors: Chun Teng Tseng, Sanwan Township, Miaoli County (TW); David Shau Chew Wang, Taipei (TW); Chi Jen Su, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 124 days.

(21) Appl. No.: 13/901,100

(22) Filed: May 23, 2013

(65) Prior Publication Data

US 2014/0118871 A1 May 1, 2014

(30) Foreign Application Priority Data

Oct. 31, 2012 (TW) ..... 101140460 A

(51) Int. Cl.

| | |
|---|---|
| ***H01C 7/10*** | (2006.01) |
| ***H01C 17/00*** | (2006.01) |
| ***H01C 1/14*** | (2006.01) |
| ***H01C 7/02*** | (2006.01) |
| ***H01C 1/146*** | (2006.01) |
| ***H01C 17/065*** | (2006.01) |

(52) U.S. Cl.

CPC ..... *H01C 17/00* (2013.01); *H01C 1/1406* (2013.01); *H01C 7/022* (2013.01); *H01C 1/146* (2013.01); *H01C 17/0652* (2013.01)

USPC ..... 338/22 R; 338/13

(58) Field of Classification Search

CPC ..... H01C 1/1406; H01C 1/142; H01C 1/146; H01C 7/02; H01C 7/022; H01C 17/00; H01C 17/06; H01C 17/0652

See application file for complete search history.

(56) References Cited

U.S. PATENT DOCUMENTS

| | | | | |
|---|---|---|---|---|
| 5,831,510 | A * | 11/1998 | Zhang et al. | 338/22 R |
| 5,884,391 | A * | 3/1999 | McGuire et al. | 29/612 |
| 8,482,373 | B1 * | 7/2013 | Tseng et al. | 338/20 |
| 2003/0001717 | A1 * | 1/2003 | Zhang | 338/22 R |
| 2004/0022001 | A1 * | 2/2004 | Chu et al. | 361/103 |

* cited by examiner

*Primary Examiner* — Kyung Lee

(74) *Attorney, Agent, or Firm* — Egbert Law Offices, PLLC

(57) ABSTRACT

A surface mountable over-current protection device having upper and lower surfaces comprises a PTC device, first and second electrodes, and first and second circuits. The PTC device comprises a PTC material layer and first and second conductive layers. The PTC material layer is disposed between the conductive layers and comprises crystalline polymer and conductive filler dispersed therein. The first electrode comprises a pair of first metal foils, whereas the second electrode comprises a pair of second metal foils. The first circuit connects the first electrode and conductive layer, and has a first planar line extending horizontally. The second circuit connects the second electrode and conductive layer, and has a second planar line extending horizontally. At least one of the planar lines has a thermal resistance sufficient to mitigate heat dissipation by which the over-current protection device undergoes a test at 25° C. and 8 amperes can trip within 60 seconds.

26 Claims, 8 Drawing Sheets

SURFACE MOUNTABLE OVER-CURRENT PROTECTION DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to an over-current protection device, and more particularly to a surface-mountable over-current protection device.

2. Description of Related Art Including Information Disclosed Under 37 CFR 1.97 and 37 CFR 1.98

Over-current protection devices are used for protecting circuitries from damage caused by over-heat or over-current. An over-current protection device usually contains two electrodes and a resistive material disposed therebetween. The resistive material has positive temperature coefficient (PTC) characteristic that the resistance thereof remains extremely low at room temperature and instantaneously increases to thousand times when the temperature reaches a critical temperature or the circuit has over-current, so as to suppress over-current and protect the cell or the circuit device. When the resistive material gets back to the room temperature or over-current no longer exists, the over-current protection device returns to be of low resistance and as a consequence the circuitry again operate normally. In view of the reusable property, the PTC over-current protection devices can replace traditional fuses, and have been widely applied to high density circuits.

When a low-resistance and high-current PTC device is surface-mounted to a printed circuit board or a mother board of which the connecting line has different widths according to various designs. Most of the copper connecting lines of the mother board connecting to the PTC device have a larger circuit area, therefore the trip time of the PTC device may be out of the specification. Owing to small difference of abnormal current and hold current of the PTC device and more efficient heat dissipation of the connecting line with a larger circuit area, the heat accumulation rate of the PTC device is lowered and therefore the trip time of the PTC device will be delayed.

If abnormal over-current event is not removed for a long time, the PTC material may be deteriorated, burned, and/or a short circuit may occur between the upper and lower metal foils of the PTC material layer. As a result, the PTC device no longer provides over-current protection and therefore the circuits of the mother board or the circuit boards may be burned or damaged also.

BRIEF SUMMARY OF THE INVENTION

The present application relates to an over-current protection device, and more particularly to a surface-mountable over-current protection device. The over-current protection device of the present application can trip timely to be in compliance with the specification regardless of the different connecting lines on the circuit board or the mother board.

According to an embodiment of the present application, a surface-mountable over-current protection device has opposite upper and lower surfaces. The surface-mountable over-current protection device comprises a PTC device, a first electrode, a second electrode, a first circuit and a second circuit. The PTC device comprises a PTC material layer, a first conductive layer and a second conductive layer. The PTC material layer is disposed between the first conductive layer and the second conductive layer and contains crystalline polymer and conductive filler, e.g., carbon black, metal or conductive ceramic powder, dispersed therein. The first electrode comprises a pair of first metal foils formed at the upper and lower surfaces of the device, and the second electrode comprises a pair of second metal foils formed at the upper and lower surfaces of the device. The first circuit is configured to electrically connect the first electrode and the first conductive layer, and comprises a first planar line extending horizontally and a first conductive connecting member extending vertically. The second circuit is configured to electrically connect the second electrode and the second conductive layer, and comprises a second planar line extending horizontally and a second conductive connecting member extending vertically. At least one of the first planar line and the second planar line has a thermal resistance sufficient to mitigate heat dissipation by which the over-current protection device undergoes a test at 25° C. and 8 amperes can trip within 60 seconds.

In an embodiment, if a short-circuit between the first and second conductive layers occurs, this event may be caused by the deterioration of the PTC material layer when over-current happens, at least one of the first and second planar lines is so narrow that it can be melted and broken to cut off the over-current.

In an embodiment, at least one of the first and second planar lines has a minimum width less than ⅔ of the width of the connected corresponding first electrode or second electrode.

In an embodiment, the ratio of the length along current flowing direction to the minimum width of the first and/or second planar line is greater than one.

According to another embodiment of the present application, a surface-mountable over-current protection device has opposite upper and lower surfaces. The surface-mountable over-current protection device comprises a PTC device, a first electrode, a second electrode, a first circuit and a second circuit. The PTC device comprises a PTC material layer, a first conductive layer and a second conductive layer. The PTC material layer is disposed between the first conductive layer and the second conductive layer and contains crystalline polymer and conductive filler dispersed therein. The first electrode comprises a pair of first metal foils formed at the upper and lower surfaces of the device, and the second electrode comprises a pair of second metal foils formed at the upper and lower surfaces of the device. The first circuit electrically connects to the first electrode and the first conductive layer, whereas the second circuit electrically connects to the second electrode and the second conductive layer. At least one of the first and second circuits comprises a fuse element, and the fuse element and the PTC device are in series connection between the first and second electrodes. If a short-circuit between the first and second conductive layers occurs due to the deterioration of the PTC material layer, the fuse element will be melted and broken to cut off short-circuit current. In an embodiment, the fuse element has a minimum width less than ⅔ of the width of the first or second electrode.

Because narrow planar circuits are employed, the device will not be affected by high heat dissipation to the external circuit to delay trip timing if abnormal current occurs. Therefore, the surface-mountable over-current protection device of the present application can meet the test requirement of the specification. More specifically, the planar line is so thin that it has sufficient thermal resistance to mitigate heat dissipation, and therefore the device can trip timely to meet the specification.

Moreover, if the over-current is not removed for a long time, the PTC material sustained in high-temperature trip state will be deteriorated, or carbonized, for example. As a consequence, the first and second conductive layers in open-circuit state when the device trips may change to be in short-circuit state. When short-circuit occurs, instantaneous large current can melt and break the planar line to cut off the current so as to provide fuse protection. Even if there is short-circuit in the over-current protection device, the device contains a circuit to be melted and broken and therefore the short-circuit will not damage the circuits of the mother board or the circuit board. By means of changing the internal or external line circuit of the device, the narrow planar line can be melted and broken first if short-circuit occurs between the upper and lower conductive layer of the PTC device, so as to prevent the circuits in the circuit board from damage or explosion.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1A:
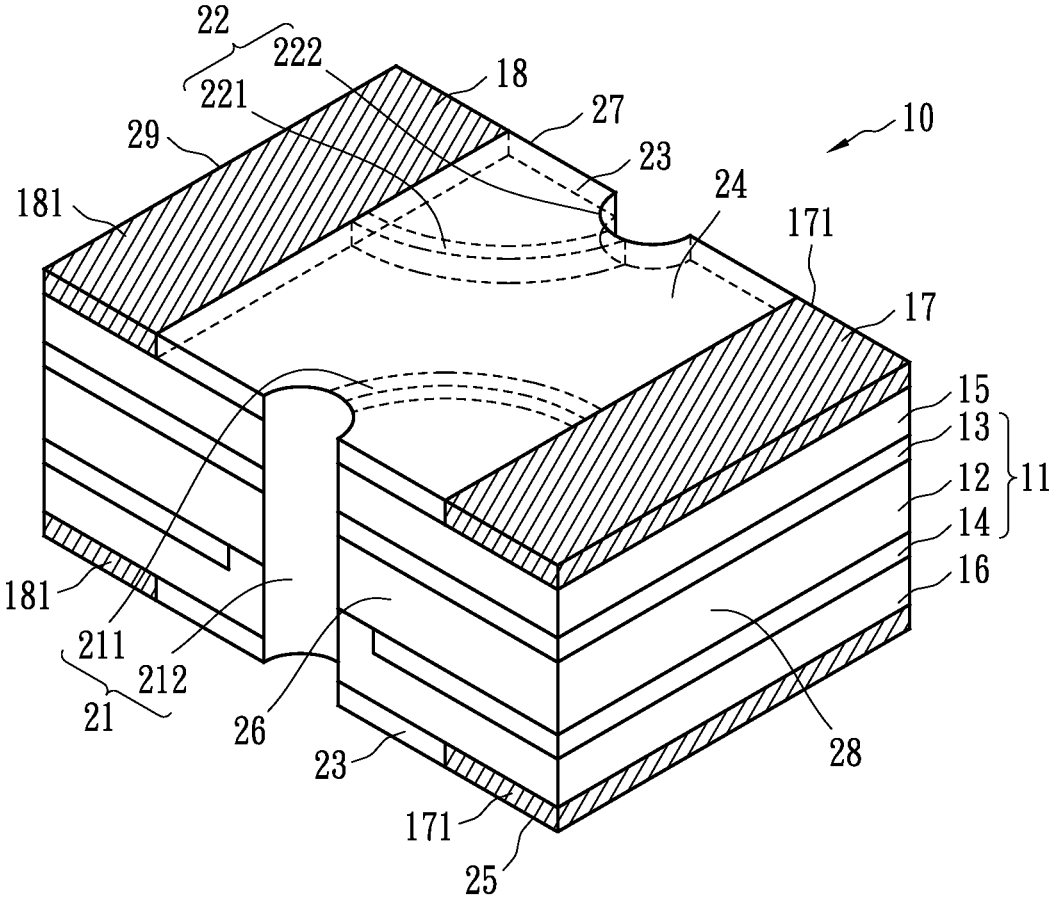
FIGS. 1A to 1C show a surface-mountable over-current protection device in accordance with a first embodiment of the present application.

FIG. 1A shows a surface-mountable over-current protection device 10, which is a substantially rectangular cuboid having a upper surface 24, a lower surface 25, a first lateral surface 26, a second lateral surface 27, a first end surface 28 and a second end surface 29. The first and second lateral surfaces 26 and 27 are opposite to each other, and the first and second end surfaces 28 and 29 are opposite to each other. The lateral surfaces 26 and 27 and the end surfaces 28 and 29 interconnect the upper and lower surfaces 24 and 25. The surface-mountable over-current protection device 10 comprises a PTC device 11, a first electrode 17, a second electrode 18, a first circuit 21 and a second circuit 22. The PTC device 11 comprises a PTC material layer 12, a first conductive layer 13 and a second conductive layer 14. The PTC material layer 12 is disposed between the first and second conductive layers 13 and 14 and comprises crystalline polymer and conductive filler dispersed therein. The first electrode 17 comprises a pair of first metal foils 171 formed at the upper and lower surfaces 24 and 25, and the second electrode 18 comprises a pair of second metal foils 181 formed at the upper and lower surfaces 24 and 25. The first circuit 21 is configured to electrically connect the first electrode 17 and the first conductive layer 13, and comprises a first planar line 211 extending horizontally and a first conductive connecting member 212 extending vertically. The second circuit 22 is configured to electrically connect the second electrode 18 and the second conductive layer 14 and comprises a second planar line 221 extending horizontally and a second conductive connecting member extending vertically 222.

In an embodiment, the first planar line 211 is formed at the upper surface 24 and connects to the first electrode 17. The first conductive connecting member 212 is formed at the first lateral surface 26, and connects to the first planar line 211 and the first conductive layer 13. The second planar line 221 is formed at the upper surface 24 and connects to the second electrode 18. The second conductive connecting member 222 is formed at the second lateral surface 27, which is opposite to the lateral surface 26, and connects to the second planar line 221 and the second conductive layer 14. The first and second conductive connecting member 212 and 222 may be conductive plated through holes (PTH) as shown in FIG. 1A. In this embodiment, because the first and second planar lines 211 and 221 are formed at the upper surface 24 only, the device 10 has to be turned upside down for undergoing soldering in surface-mount process. That is, the metal foils 171 and 181 at the surface 24 serve as soldering interfaces.

In another embodiment, the lower surface 25 may be further provided with planar lines as those formed at the upper surface 24, and as a result it is not necessary to consider the device direction for soldering.

In yet another embodiment, a vertical conductive hole may be formed at the first end surface 28 to connect the upper and lower metal foils 171, and the vertical conductive hole is insulated from the first and second conductive layers 13 and 14. Likewise, another vertical conductive hole may be formed at the second end surface 29 to connect the upper and lower metal foils 181, and is insulated from the first and second conductive layers 13 and 14. As a result, the upper and lower metal foils 171 are electrically connected, and the upper and lower metal foils 181 are electrically connected. Therefore, even if there is no planar lines at the lower surface 25, it is not necessary to consider device direction for soldering either.

Figure 1B:
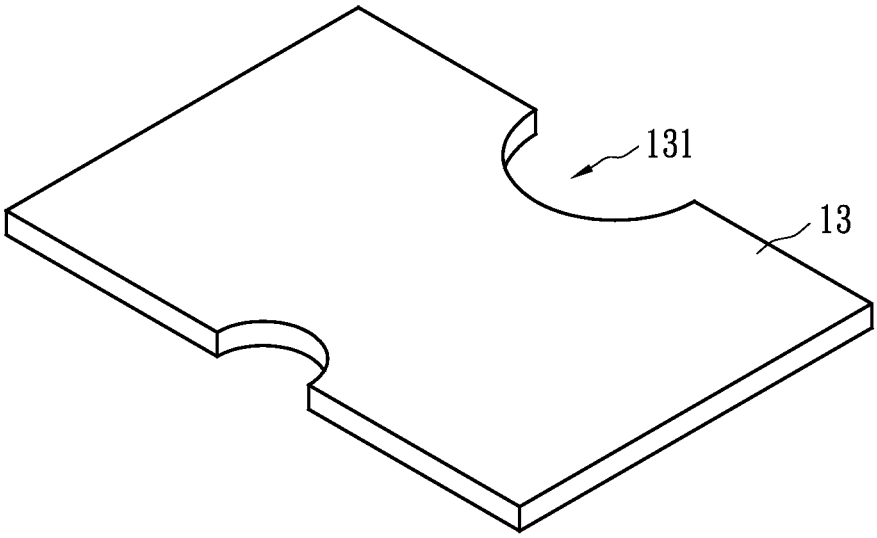
Figure 1C:
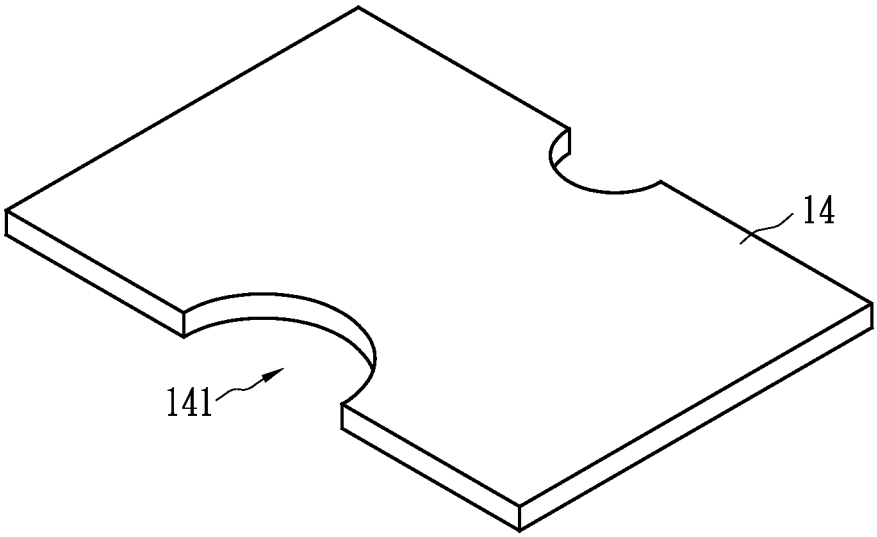

FIG. 1B shows the first conductive layer 13 in accordance with an embodiment. The first conductive layer 13 has a notch 131 at the second lateral surface 27 for being insulated from the second conductive connecting member 222. In this embodiment, the notch 131 is semi-circular and has a radius larger than that of the second conductive connecting member 222. FIG. 1C shows the second conductive layer 14 in accordance with an embodiment. The second conductive layer 14 has a notch 141 at the first lateral surface 26 for being insulated from the second conductive connecting member 212. In this embodiment, the notch 141 is semi-circular and has a radius larger than that of the first conductive connecting member 212. The notches 131 and 141 may be of other shapes such as rectangle as long as they are isolated from the conductive connecting members 212 and 222.

The first insulating layer 15 is formed on the first conductive layer 13, and the second insulating layer 16 is formed on the second conductive layer 14. The first and second metal foils 171 and 181 at the upper surface 24 are formed on the first insulating layer 15, and the first and second metal foils 171 and 181 at the lower surface 25 are formed on the second insulating layer 16. A solder mask 23 is formed on a surface of the insulating layer 15 between the first and second metal foils 171 and 181 at the upper surface 24, and overlays the planar lines 211 and 221. Similarly, the second insulating layer may be overlaid by a solder mask 23 as well for insulation.

Figure 1D:
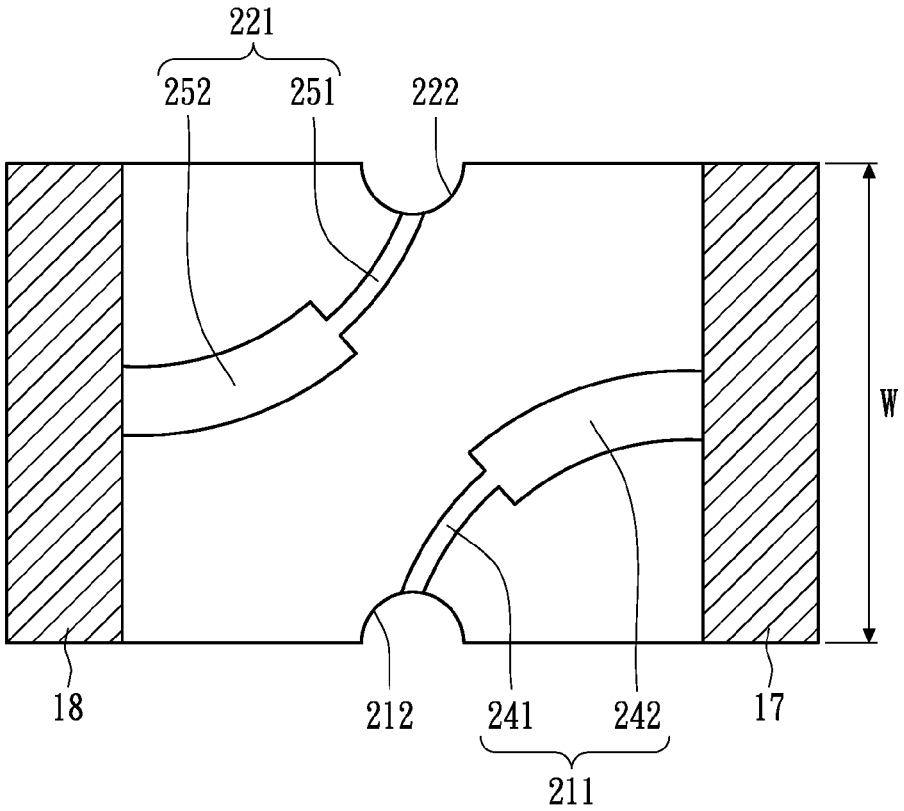
FIG. 1D shows a top view of a surface-mountable over-current protection device with different planar lines compared to the first embodiment.

FIG. 1D shows the planar lines of other shapes of the first embodiment. The planar line 211 is wider at the end connecting to the first electrode 17, and is narrower at the end connecting to the first conductive connecting member 212, e.g., a first portion 241 with a narrower line width and a second portion 242 with a wider line width. Similarly, the planar line 221 is wider at the end connecting to the second electrode 18, and is narrower at the end connecting to the second conductive connecting member 222, e.g., a first portion 251 with a narrower line width and a second portion 252 with a wider line width. The planar lines of the present application include but not limited to the above embodiments. Alternatively, the planar line may be narrower at the end connecting to the electrode and be wider at the end connecting to the conductive connecting member. Variations of planar line width or the planar line shapes can be used also. The planar lines are made of metal or alloy, may be of a single-layer or a multi-layer structure with same or different material layers, and may be formed by electroplating, sputtering, extrusion, or calendering. The planar line may be in an arc, curve, dumbbell, or notch shape to effectively control the resistance thereof, thereby determining the most heat generation portion of the planar line. As such, generation heat and conduction way of the planar lines can be determined specifically.

In an embodiment, the first planar line 211 has a minimum width less than ⅔ of the first electrode 17, and/or the second planar line 221 has a minimum width less than ⅔ of the second electrode 18. For example, the minimum width of the first portion 241 is less than ⅔ of the width "W" of the first electrode 17, and the minimum width of the first portion 251 is less than ⅔ of the width "W" of the second electrode 18. In practice, the minimum width of the planar line may be less than ½ or ⅓ for increasing thermal resistance further. In another embodiment, the ratio of the length along current flowing direction to the minimum width of the first planar line 211 and/or second planar line 221 is greater than 1, or larger than 2, 3, 5, 7 or 10 in particular. The ratio usually is not greater than 20. When current goes through narrower first planar line 211 or second planar line 221 in comparison with the widths of the electrode 17 or 18, the higher electrical resistance of the planar lines 211 and 221 will generate heat. However, the smaller heat conduction area of the planar line 211 or 221 has higher thermal resistance. Therefore, the heat generated from the PTC material layer 12 cannot be conducted or dissipated effectively. In other words, the planar line has a thermal resistance sufficient to mitigate heat dissipation, so that the over-current protection device 10 can be trip timely to pass the specification test.

Figure 2A:
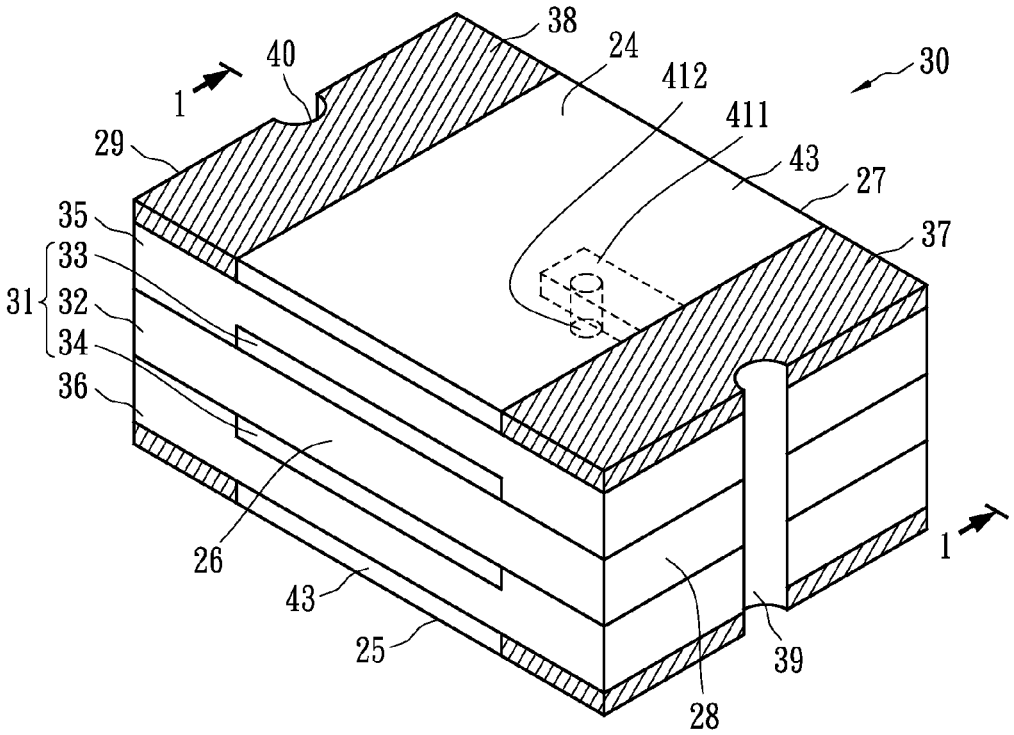
FIGS. 2A and 2B show a surface-mountable over-current protection device in accordance with a second embodiment of the present application.
Figure 2B:
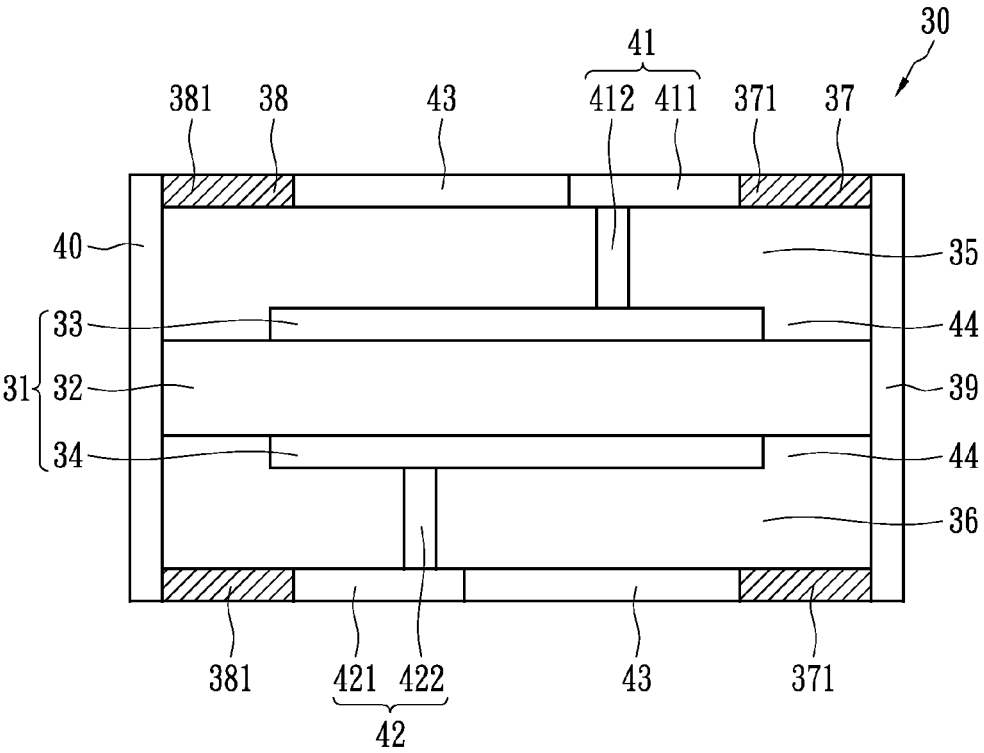

FIG. 2A shows a surface-mountable over-current protection device 30 in accordance with a second embodiment of the present application, which is a rectangular cuboid having an upper surface 24, a lower surface 25, a first lateral surface 26, a second lateral surface 27, a first end surface 28 and a second end surface 29. FIG. 2B is the cross-sectional view along line 1-1 of FIG. 2A. The surface-mountable over-current protection device 30 comprises a PTC device 31, a first electrode 37, a second electrode 38, a first circuit 41 and a second circuit 42. The PTC device 31 comprises a PTC material layer 32, a first conductive layer 33 and a second conductive layer 34. The PTC material layer 32 is disposed between the first and second conductive layers 33 and 34 and comprises crystalline polymer and conductive filler dispersed therein. The first electrode 37 comprises a pair of first metal foils 371 formed at the upper and lower surfaces 24 and 25. The first metal foils 371 at the upper and lower surfaces 24 and 25 are electrically connected by a conductor 39, e.g., a conductive plated through hole as shown in FIG. 2A, or a conductive surface. The second electrode 38 comprises a pair of second metal foils 381 formed at the upper and lower surfaces 24 and 25. The second metal foils 381 at the upper and lower surfaces 24 and 25 are electrically connected by a conductor 40, e.g., a conductive plated through hole or a conductive surface. The first circuit 41 is configured to electrically connect the first electrode 37 and the first conductive layer 33, and comprises a first planar line 411 extending horizontally and a first conductive connecting member 412 extending vertically. The second circuit 42 is configured to electrically connect the second electrode 38 and the second conductive layer 34 and comprises a second planar line 421 extending horizontally and a second conductive connecting member extending vertically 422. The conductive layers 33 and 34 have notches 44 for being isolated from the conductors 39 and 40.

A first insulating layer 35 is formed on the first conductive layer 33, and the second insulating layer 36 is formed on the second conductive layer 34. The first and second metal foils 371 and 381 at the upper surface 24 are formed on the first insulating layer 35, and the first and second metal foils 371 and 381 at the lower surface 25 are formed on the second insulating layer 36. The first planar line 411 is formed at the upper surface 24, and the first conductive connecting member 412 penetrates through the first insulating layer 35 and connects to the first planar line 411 and the first conductive layer 33. The second planar line 421 is formed at the lower surface 25, and the second conductive connecting member 422 penetrates through the second insulating layer 36 and connects to the second planar line 421 and the second conductive layer 34. A solder mask 43 is formed on a surface of the insulating layer 35 between the first and second electrode 37 and 38, and overlays the planar line 411. Similarly, a second insulating layer 36 and the planar line 421 may be overlaid by a solder mask 43 as well for insulation. The planar line 411 and the metal foil 371 may be formed from a same metal foil by etching; therefore the planar line 411 and the metal foil 371 may have a same thickness. Accordingly, the solder mask 43 on top of the planar line 411 is very thin, and is not illustrative in FIG. 2B for ease of explanation. Likewise, the solder mask 43 on the planar line 421 is not illustrative in FIG. 2B either.

Figure 2C:
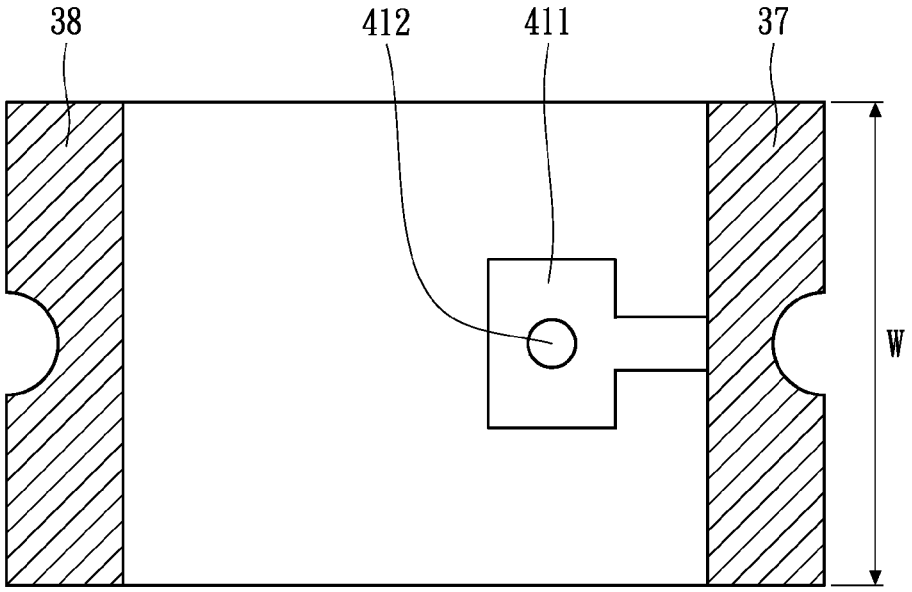
FIG. 2C shows a top view of a surface-mountable over-current protection device with different planar lines compared to the second embodiment.

FIG. 2C shows the planar lines of other shapes of the second embodiment. The planar line 411 is narrower at the end connecting to the first electrode 37, and is wider at the end connecting to the first conductive connecting member 412. Similarly, the planar line 421 is narrower at the end connecting to the second electrode 38, and is wider at the end connecting to the second conductive connecting member 422. The planar lines of the present application include but not limited to the above embodiments. Alternatively, the planar line may be wider at the end connecting to the electrode and be narrower at the end connecting to the conductive connecting member. Variations of planar line width or the planar line shapes, e.g., an arc or a curve, can be used also.

In practice, the first and second circuits 41 and 42 of the over-current protection device 30 need not exist simultaneously. The device can mitigate heat dissipation as long as one of the circuits 41 and 42 can provide sufficient thermal resistance. For example, the first circuit 41 may be as shown in FIG. 2B, and the second circuit 42 in FIG. 2B can be omitted. However, the second conductive layer 34 has to be electrically connected to the conductor 40 to electrically couple to the second electrode 38.

Likewise, the ratio of the minimum width of the planar line to the width of the electrode and the ratio of the length along current flowing direction to the minimum width of the planar line have to meet the requirement as mentioned in the first embodiment, so as to obtain sufficient thermal resistance to mitigate heat dissipation and avoid the delay of trip timing.

The planar lines for preventing heat dissipation of the surface-mountable over-current protection device of the above two embodiments are formed at the device surface, i.e. the planar lines are external circuits. The planar lines can be formed inside the device as internal circuit as well, as mentioned below.

Figure 3A:
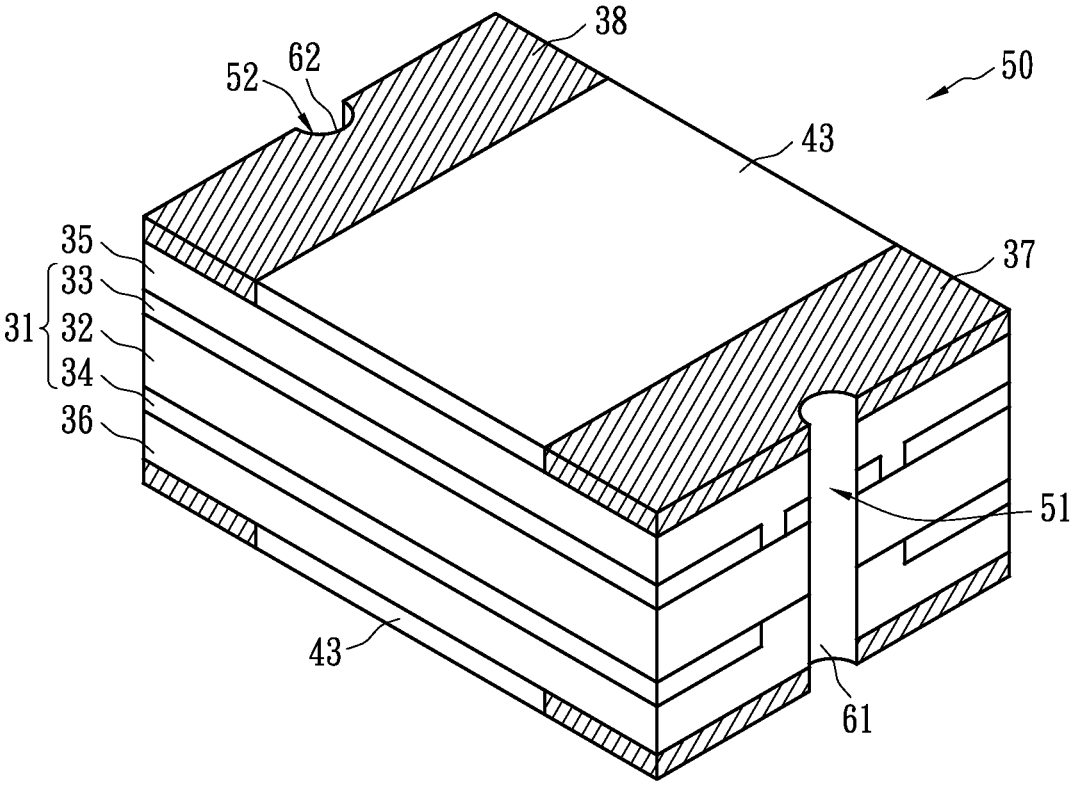
FIGS. 3A to 3C show a surface-mountable over-current protection device in accordance with a third embodiment of the present application.
Figure 3B:
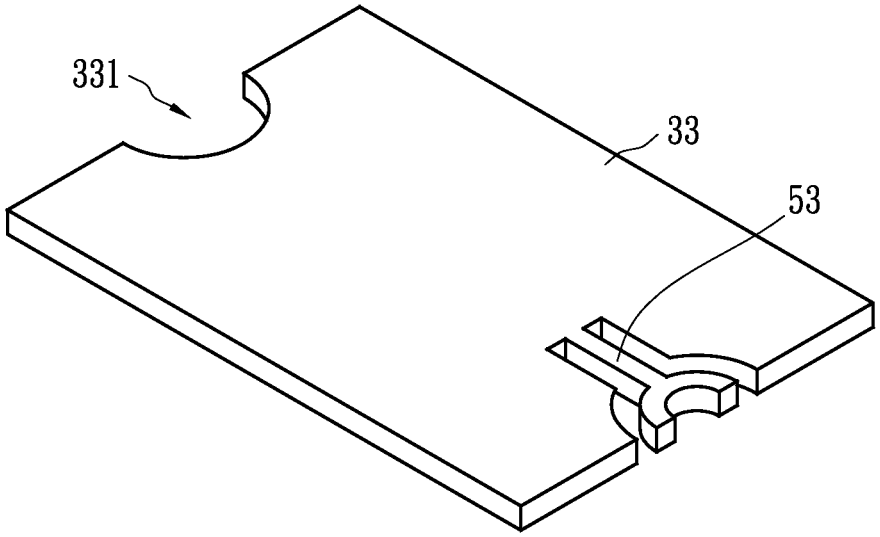
Figure 3C:
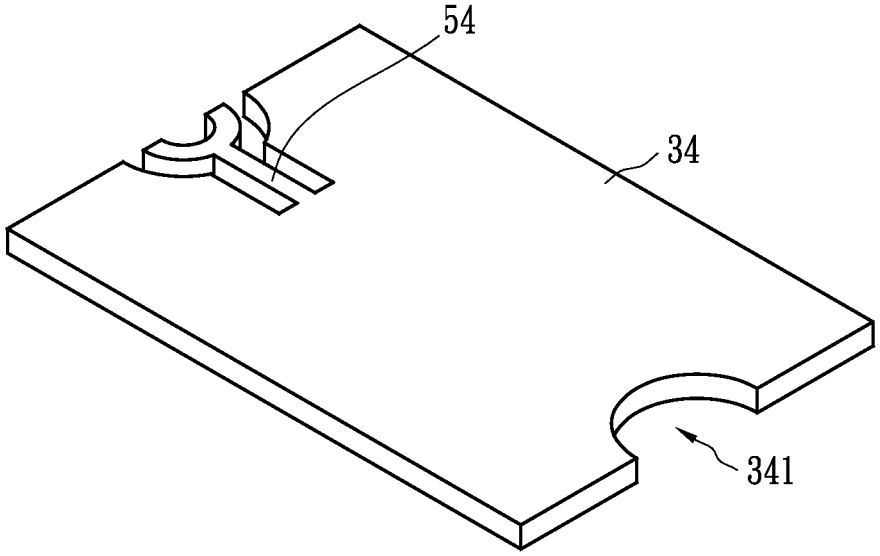

FIG. 3A shows a surface-mountable over-current protection device 50 in accordance with a third embodiment of the present application, the appearance is similar to the device 30 of the second embodiment except that the planar line is fabricated inside the device 50. FIGS. 3B and 3C show the first conductive layer 33 and the second conductive layer 34, respectively. The first circuit 51 is configured to electrically connect the first electrode 37 and the first conductive layer 33, and comprises a first planar line 53 extending horizontally and a first conductive connecting member 61 extending vertically. The second circuit 52 is configured to electrically connect the second electrode 38 and the second conductive layer 34 and comprises a second planar line 54 extending horizontally and a second conductive connecting member 62 extending vertically. More specifically, the first conductive connecting member 61 is formed at an end surface of the device 50 and connects to the first electrode 37. The first planar line 53 connects to the first conductive connecting member 61 and the first conductive layer 33, and the first planar line 53 and the first conductive layer 33 are at the same plane. The second conductive connecting member 62 is formed at another end surface of the device 50 and connects to the second electrode 38. The second planar line 54 connects to the second conductive connecting member 62 and the second conductive layer 34, and the second planar line 54 and the second conductive layer 34 are at the same plane. The first conductive layer 33 has a notch 331 for being isolated from the second conductive connecting member 62, whereas the second conductive layer 34 has a notch 341 for being isolated from the first conductive connecting member 61. In an embodiment, the first planar line 53 has a minimum width less than ⅔ or ½ of the width of the first electrode 37, and the second planar line 54 has a minimum width less than ⅔ or ½ of the width of the second electrode 38.

Because the narrow planar line 53 or 54 has high electrical resistance, it will generate heat when electric current flows therethrough. Moreover, the smaller heat conduction area of the planar line 53 or 54 has higher thermal resistance. Therefore, the heat generated from the PTC material layer 32 will not be conducted or dissipated rapidly, thereby avoiding the delay of trip timing.

The PTC material layers 12 and 32 contain crystalline polymer and conductive filler and exhibit PTC characteristic. The crystalline polymer material layer may comprise high-density polyethylene (HDPE), medium-density polyethylene, low-density polyethylene (LDPE), polypropylene, polyvinyl chlorine, polyvinyl fluoride, copolymer of ethylene and acrylic acid, copolymer of ethylene and acrylic resin, copolymer of ethylene and vinyl alcohol, or the combination thereof. The conductive filler may be metal powder or conductive ceramic carbide powder of a resistivity less than 500 μΩ-cm. The conductive filler may comprise nickel, cobalt, copper, iron, tin, lead, silver, gold, platinum, tungsten carbide, vanadium carbide, titanium carbide, boron carbide, silicon carbide, germanium carbide, tantalum carbide, zirconium carbide, chromium carbide, molybdenum carbide or the mixture, alloy, solid solution or core-shell thereof. By using the conductive filler with low resistivity, the resistivity of the PTC material layer 12 or 32 is less than 0.2 Ω-cm.

The over-current protection devices each having a single PTC device are exemplified above. The present application can also be applied to a device structure having multiple PTC devices in series connection, such as the double-PTC device structure shown in U.S. Pat. No. 6,377,467.

Thermal resistance is equal to L/kA, where "L" is the length through which heat transfers, "A" is the cross-sectional area through which heat transfers, and "k" is the thermal conductivity of material. It can be seen from the equation that the thermal resistance is larger if "A" is smaller or "L" is larger. The larger the thermal resistance, the worse the heat dissipation is. In other words, the circuit having higher thermal resistance will obtain better prevention to heat dissipation.

Table 1 shows thermal resistances corresponding to the devices in terms of various form factors, planar line structures, and sizes. The material of the planar lines includes but not limited to copper. The thermal resistance L/kA corresponds to a single planar line. As said, if the thermal resistance of a single planar line is sufficient, the heat dissipation can be mitigated effectively.

TABLE 1

| Example | Form Factor | Figure | L (mm) | A ($mm^2$) | k (W/m~K) | L/kA (K/W) |
|---|---|---|---|---|---|---|
| 1 | 1812 | FIG. 1 | 1.27 | 0.025 | 401 | 127 |
| 2 | 1812 | FIG. 1 | 1.5 | 0.015 | 401 | 249 |
| 3 | 1812 | FIG. 1 | 1.8 | 0.007 | 401 | 641 |
| 4 | 1812 | FIG. 1 | 2.13 | 0.0018 | 401 | 2951 |
| 5 | 1812 | FIG. 2 | 0.15 | 0.054 | 401 | 7 |
| 6 | 1812 | FIG. 2 | 0.8 | 0.025 | 401 | 80 |
| 7 | 1812 | FIG. 2 | 1.6 | 0.012 | 401 | 333 |
| 8 | 1812 | FIG. 2 | 3.2 | 0.002 | 401 | 3990 |
| 9 | 1210 | FIG. 1 | 0.7 | 0.017 | 401 | 103 |
| 10 | 1210 | FIG. 1 | 0.8 | 0.012 | 401 | 166 |
| 11 | 1210 | FIG. 1 | 1.12 | 0.006 | 401 | 466 |
| 12 | 1210 | FIG. 1 | 1.49 | 0.0017 | 401 | 2186 |
| 13 | 1210 | FIG. 2 | 0.13 | 0.041 | 401 | 8 |
| 14 | 1210 | FIG. 2 | 0.5 | 0.025 | 401 | 50 |
| 15 | 1210 | FIG. 2 | 1.2 | 0.011 | 401 | 272 |
| 16 | 1210 | FIG. 2 | 1.98 | 0.0017 | 401 | 2905 |

TABLE 1-continued

| Example | Form Factor | Figure | L (mm) | A ($mm^2$) | k (W/m~K) | L/kA (K/W) |
|---|---|---|---|---|---|---|
| 17 | 1206 | FIG. 1 | 0.74 | 0.017 | 401 | 109 |
| 18 | 1206 | FIG. 1 | 0.84 | 0.008 | 401 | 262 |
| 19 | 1206 | FIG. 1 | 0.95 | 0.004 | 401 | 592 |
| 20 | 1206 | FIG. 1 | 1.03 | 0.0017 | 401 | 1511 |
| 21 | 1206 | FIG. 2 | 0.13 | 0.027 | 401 | 12 |
| 22 | 1206 | FIG. 2 | 0.52 | 0.011 | 401 | 118 |
| 23 | 1206 | FIG. 2 | 1.01 | 0.006 | 401 | 420 |
| 24 | 1206 | FIG. 2 | 1.57 | 0.0017 | 401 | 2303 |

Moreover, the devices of the above examples in Table 1 are subjected to tests by a circuit board with a line width of 60 mil. The ambient temperature of the tests are 25° C. The supply voltage is the maximum voltage of the specification of the devices, and the test current is 8 amperes. The voltage and current curves of the devices are recorded by an oscilloscope. The oscilloscope starts calculating the time when the current increases by 20%, and ends the calculation when the current decreases from the maximum current by 20%. The time period is the responding time or trip time of the device. It indicates that the device is tripped when the current decreases by 20%. In contrast, it indicates that the device does not trip if the current does not decrease.

It can be seen from Table 1 that the thermal resistances of the examples 5, 6, 13, 14 and 24 are less than 100 K/W, such small thermal resistance cannot effectively avoid heat dissipation. The thermal resistance of the devices is equal to or greater than 100 K/W, or greater than 200 K/W or 400 K/W in particular, so as to mitigate heat dissipation effectively. The devices of other examples can trip within 60 seconds when undertaking 8 amperes, in which the devices with larger thermal resistances can even trip within 5 seconds.

The PTC material may be burned due to the deterioration of the PTC material when the device had been tripped for a long time period. As a result, a short-circuit event may occur between the upper and lower conductive layers of the PTC device. When a short-circuit occurs, the first planar line and second planar line can serve as fuse elements if one or both of them are so narrow that it or they can be melted to change to be open-circuit. That is, the first planar line and the second planar line function as fuses, providing further over-current protection.

Figure 4:
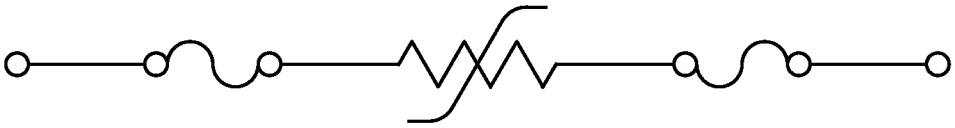
FIG. 4 shows an equivalent circuit diagram in accordance with the surface-mountable over-current protection device of the present application.

If the planar line is so narrow that it can be melted to be open-circuit when over-current occurs, the planar line is equivalent to a fuse. Accordingly, the equivalent circuit of the over-current protection device is shown in FIG. 4, in which the two ends of the equivalent circuit correspond to the two electrodes, the PTC device is the resistive device, and the first and the second planar lines are the two fuse elements. The fuse elements and the PTC device are connected in series between the first and second electrodes. When a short-circuit occurs between the first conductive layer and the second conductive layer of the PTC device due to the deterioration of the PTC material, the fuse element is so narrow that it can be melted to change to be open-circuit.

Not only does the surface-mountable over-current protection device of the present application solve the issue that the device cannot trip timely under the test of the specification, but also it contains equivalent fuse elements to provide further protection to the circuit board mounted with the over-current protection device if the PTC device is dysfunctional.

The above-described embodiments of the present invention are intended to be illustrative only. Numerous alternative embodiments may be devised by persons skilled in the art without departing from the scope of the following claims.

We claim:

1. A surface-mountable over-current protection device being a substantially rectangular cuboid having upper and lower surfaces, a first lateral surface, a second lateral surface, a first end surface and a second end surface, the first and second lateral surfaces and the first and second end surfaces interconnecting the upper and lower surfaces; the over-current protection device comprising:

a PTC device comprising a PTC material layer, a first conductive layer and a second conductive layer, the PTC material layer being disposed between the first and second conductive layers, and comprising crystalline polymer and conductive filler dispersed therein;

a first electrode comprising a pair of first metal foils formed at the upper and lower surfaces;

a second electrode comprising a pair of second metal foils formed at the upper and lower surfaces;

a first circuit electrically connecting the first electrode and the first conductive layer and comprising a first planar line extending horizontally and a first conductive connecting member extending vertically; and a second circuit electrically connecting the second electrode and the second conductive layer and comprising a second planar line extending horizontally and a second conductive connecting member extending vertically;

wherein at least one of the first planar line and the second planar line has a thermal resistance sufficient to mitigate heat dissipation, thereby the over-current protection device undergoes a test at 25° C. and 8 amperes can trip within 60 seconds.

2. The surface-mountable over-current protection device of claim 1, wherein the first planar line has a minimum width less than ⅔ of a width of the first electrode.

3. The surface-mountable over-current protection device of claim 2, wherein the second planar line has a minimum width less than ⅔ of a width of the second electrode.

4. The surface-mountable over-current protection device of claim 1, wherein the first planar line is formed at the upper surface, the lower surface or both and is connected to the first electrode; the first conductive connecting member connects to the first planar line and the first conductive layer; the second planar line is formed at the upper surface, the lower surface or both and is connected to the second electrode; the second conductive connecting member connects to the second planar line and the second conductive layer.

5. The surface-mountable over-current protection device of claim 1, wherein the second lateral surface is opposite to the first lateral surface, the first conductive connecting member is formed at the first lateral surface and the second conductive connecting member is formed at the second lateral surface.

6. The surface-mountable over-current protection device of claim 5, wherein the first conductive layer has a first notch for being isolated from the second conductive connecting member, and the second conductive layer has a second notch for being isolated from the first conductive connecting member.

7. The surface-mountable over-current protection device of claim 1, wherein the first and second conductive connecting members are conductive plated through holes.

8. The surface-mountable over-current protection device of claim 1, wherein the ratio of the length along current flowing direction to the minimum width of the first planar line is greater than one.

9. The surface-mountable over-current protection device of claim 1, wherein the first or second planar line is so narrow that it can be melted and broken to cut off current when a short-circuit between the first and second conductive layers occurs.

10. The surface-mountable over-current protection device of claim 1, further comprising:

a first insulating layer formed on the first conductive layer; and a second insulating layer formed on the second conductive layer;

wherein the first and second metal foils at the upper surface are formed on the first insulating layer, and the first and second metal foils at the lower surface are formed on the second insulating layer.

11. The surface-mountable over-current protection device of claim 10, wherein the first planar line is formed at the upper surface, the first conductive connecting member penetrates through the first insulating layer and connects to the first planar line and the first conductive layer, the second planar line is formed at the lower surface, and the second conductive connecting member penetrates through the second insulating layer and connects to the second planar line and the second conductive layer.

12. The surface-mountable over-current protection device of claim 11, further comprising a first conductor at the first end surface and a second conductor at the second end surface, the first conductor connects to the first metal foils at the upper and lower surfaces, and is insulated from the first and second conductive layers, the second conductor connects to the second metal foils at the upper and lower surfaces, and is insulated from the first and second conductive layers.

13. The surface-mountable over-current protection device of claim 1, wherein the second end surface is opposite to the first end surface, the first conductive connecting member is formed at the first end surface and connects to the first electrode, the first planar line connects to the first conductive connecting member and the first conductive layer, the first planar line and the first conductive layer are in a same plane; the second conductive connecting member is formed at the second end surface and connects to the second electrode, the second planar line connects to the second conductive connecting member and the second conductive layer, and the second planar line and the second conductive layer are in a same plane.

14. The surface-mountable over-current protection device of claim 13, wherein the first conductive connecting member is insulated from the second conductive layer, and the second conductive connecting member is insulated from the first conductive layer.

15. The surface-mountable over-current protection device of claim 13, wherein the first planar line has a minimum width less than ½ of a width of the first electrode, and the second planar line has a minimum width less than ½ of a width of the second electrode.

16. The surface-mountable over-current protection device of claim 13, wherein the first conductive connecting member connects to the first metal foils at the upper and lower surfaces, and the second conductive connecting member connects to the second metal foils at the upper and lower surfaces.

17. The surface-mountable over-current protection device of claim 13, wherein the first and second conductive connecting members are conductive plated through holes or conductive surfaces.

18. The surface-mountable over-current protection device of claim 1, wherein the first planar line or the second planar line has a thermal resistance greater than 100 K/W.

19. The surface-mountable over-current protection device of claim 1, wherein at least one of the first planar line and the second planar line has a thermal resistance sufficient to mitigate heat dissipation, thereby the PTC device undergoes a test at 25° C. and 8 amperes can trip within 5 seconds.

20. The surface-mountable over-current protection device of claim 1, wherein the PTC material layer has a resistivity less than 0.2 Ω-cm, and the conductive filler comprises nickel, cobalt, copper, iron, tin, lead, silver, gold, platinum, tungsten carbide, vanadium carbide, titanium carbide, boron carbide, silicon carbide, germanium carbide, tantalum carbide, zirconium carbide, chromium carbide, molybdenum carbide, or the mixture, alloy, solid solution or core-shell thereof.

21. The surface-mountable over-current protection device of claim 1, wherein the crystalline polymer comprises high-density polyethylene, medium-density polyethylene, low-density polyethylene, polypropylene, polyvinyl chlorine, polyvinyl fluoride, copolymer of ethylene and acrylic acid, copolymer of ethylene and acrylic resin, copolymer of ethylene and vinyl alcohol, or the combination thereof.

22. A surface-mountable over-current protection device having opposite upper and lower surfaces; the over-current protection device comprising:

a resistive device comprising a PTC material layer, a first conductive layer and a second conductive layer, the PTC material layer being disposed between the first and second conductive layers and comprising crystalline polymer and conductive filler dispersed therein;

a first electrode comprising a pair of first metal foils formed at the upper and lower surfaces;

a second electrode comprising a pair of second metal foils formed at the upper and lower surfaces;

a first circuit electrically connecting the first electrode and the first conductive layer; and a second circuit electrically connecting the second electrode and the second conductive layer;

wherein at least one of the first and second circuits comprises a fuse element, the fuse element and the resistive device are in series connection between the first and second electrodes; if a short-circuit between the first and second conductive layers occurs due to deterioration of the PTC material layer, the fuse element is melted and broken to cut off short-circuit current;

wherein the fuse element has a thermal resistance sufficient to mitigate heat dissipation thereby the over-current protection device undergoes a test at 25° C. and 8 amperes can trip within 60 seconds.

23. The surface-mountable over-current protection device of claim 22, wherein the fuse element has a minimum width less than ⅔ of the width of the first or second electrode.

24. The surface-mountable over-current protection device of claim 22, wherein the fuse element has a thermal resistance sufficient to mitigate heat dissipation thereby the over-current protection device undergoes a test at 25° C. and 8 amperes can trip within 5 seconds.

25. The surface-mountable over-current protection device of claim 22, wherein the first circuit comprises a first planar line extending horizontally and a first conductive connecting member extending vertically, and the second circuit comprises a second planar line extending horizontally and a second conductive connecting member extending vertically; at least one of the first and second planar lines comprises the fuse element.

26. The surface-mountable over-current protection device of claim 22, wherein the first circuit comprises a first planar line formed at the upper surface, the lower surface or both and a first conductive connecting member extending vertically, the first planar line connects to the first electrode, the first conductive connecting member connects to the first planar line and the first conductive layer; the second circuit comprises a second planar line formed at the upper surface, the lower surface or both and a second conductive connecting member extending vertically, the second planar line connects to the second electrode, the second conductive connecting member connects to the second planar line and the second conductive layer; at least one of the first and second planar lines comprises the fuse element.

* * * * *